US012311237B2

(12) United States Patent
Sun

(10) Patent No.: US 12,311,237 B2
(45) Date of Patent: May 27, 2025

(54) HOOP COVER FOR TRAMPOLINE AND TRAMPOLINE

(71) Applicant: Bisheng Sun, Jiangsu (CN)

(72) Inventor: Bisheng Sun, Jiangsu (CN)

( * ) Notice: Subject to any disclaimer, the term of this patent is extended or adjusted under 35 U.S.C. 154(b) by 138 days.

(21) Appl. No.: 18/312,178

(22) Filed: May 4, 2023

(65) Prior Publication Data

US 2024/0366986 A1 Nov. 7, 2024

(51) Int. Cl.
*A63B 5/11* (2006.01)
*A63B 71/00* (2006.01)

(52) U.S. Cl.
CPC ..... *A63B 5/11* (2013.01); *A63B 2071/009* (2013.01)

(58) Field of Classification Search
CPC ..... A63B 5/08; A63B 5/11; A63B 2071/009
See application file for complete search history.

(56) References Cited

U.S. PATENT DOCUMENTS 7,494,445 B1 * 2/2009 Chen ..... A63B 5/11 482/35
9,084,908 B1 * 7/2015 Chen ..... A63B 5/11
9,643,039 B2 5/2017 Andon
10,232,208 B2 * 3/2019 Chen ..... A63B 71/022
10,258,854 B2 4/2019 Chen
10,758,763 B1 9/2020 Chen
11,517,780 B2 12/2022 Seaman et al.
2006/0058157 A1 * 3/2006 Greiner ..... A63B 71/022 482/29
2019/0009120 A1 * 1/2019 Ji ..... A63B 71/022
2022/0347507 A1 11/2022 Sun
2023/0043158 A1 2/2023 Diao et al.
2023/0074996 A1 3/2023 Zhu

OTHER PUBLICATIONS

The ExacMe Trampoline Pad with opening https://www.exacme.com/products/exacme-premium-thick-trampoline-pad-with-opening-08-10-12-13-14-15-16ft-replacement-spring-cover-safety-pads-extra-storage-bag-dark-blue-6181-p-nb (Year: 2008).*
Simplie Fun Trampoline https://streamdalefurniture.com/products/32530ead-01b2-44a3-9a44-f8fb5bc6b4b7 (Year: 2022).*

* cited by examiner

*Primary Examiner* — Loan B Jimenez
*Assistant Examiner* — Jonathan A Dicuia

(57) ABSTRACT

The present disclosure provides a hoop cover for a trampoline and a trampoline. The hoop cover includes an annular cover top surface and a first side surface being cylindrical in shape, a circular edge at one side of the first side surface is fixedly connected to an outer rim edge of the cover top surface; a plurality of inner ring fixing straps are distributed along a circumferential direction at an inner rim edge of the cover top surface, each of the inner ring fixing straps is capable of being bindingly attached to the trampoline when in use; and a plurality of outer ring fixing straps are distributed and fixedly connected along a circumferential direction at the outer rim edge of the cover top surface, and each of the outer ring fixing straps is bindingly attached to the trampoline when in use.

15 Claims, 7 Drawing Sheets

A

HOOP COVER FOR TRAMPOLINE AND TRAMPOLINE

TECHNICAL FIELD

The present disclosure relates to the technical field of trampolines, in particular to a hoop cover for a trampoline and a trampoline.

BACKGROUND

The trampoline can be used as fitness and entertainment equipment, which is deeply loved by young people and children. However, most trampolines have a single color on one side and cannot be turned over. When being used for a long time, it will make people feel monotonous and boring for a single color or a fixed color on one side. Especially for children, they may lose interest after playing for a period of time, the trampoline has various parts, and thus most parts of the trampoline will become idle items that occupy more space in the family. In order to increase the demand for different colors, if a variety of hoop covers with different colors are prepared for replacement, firstly, it is more expensive and takes up more space to buy separate hoop covers, secondly, because the colors are not bright anymore after a long time of use on one side, it is not possible to fix them for direct use when there is a need to turn them over, so it is necessary to replace the hoop cover. In the prior art, the hoop cover cannot be rapidly fixed for use directly when it is turned over, therefore, it is not convenient to buy additional hoop covers for color change, if the ordinary hoop cover is designed to have top and bottom side with different color fabric, when the hoop cover is turned over, since the fixing device is facilitated for use at one side, the fixation cannot be implemented after turning over, that is, the hoop cover cannot be easily fixed after turning over.

SUMMARY

The purpose of the present disclosure is to provide a hoop cover for a trampoline, which can meet the requirements of convenient and quick fixing and stable binding when used on both sides, can achieve the use of changing the top surface and the bottom surface of the same hoop cover, and is convenient and quick to fix after turning over.

In order to achieve the above purpose, the present disclosure provides the following technical solution:

a hoop cover for a trampoline is provided, the hoop cover includes a cover top surface laid flat on an outer edge of a top surface of the trampoline and a first side surface wrapped around a side surface of an outer frame edge of the trampoline, the first side surface being cylindrical in shape, and a circular edge at one side of the first side surface being fixedly connected to an outer rim edge of the cover top surface; a plurality of inner ring fixing straps are distributed along a circumferential direction at an inner rim edge of the cover top surface, each of the inner ring fixing straps capable of being bindingly attached to the trampoline when in use; and a plurality of outer ring fixing straps are distributed and fixedly connected along a circumferential direction at the outer rim edge of the cover top surface, and each of the outer ring fixing straps being bindingly attached to the trampoline when in use.

Further, the hoop cover is provided with one threading opening for allowing the outer ring fixing straps to penetrate the hoop cover at a position corresponding to each of the outer ring fixing straps so that when the hoop cover is fixed after turning over, each of the outer ring fixing straps is bindingly attached to the trampoline through the threading opening. It is convenient for attaching the outer ring fixing straps through the threading opening to the trampoline frame after the hoop cover has been turned over.

Further, the hoop cover comprises the cover top surface with a plurality of fan-ring shaped patchwork fabric pieces stitched together in a shape of a ring.

Further, the hoop cover is provided with an opening, the hoop cover is provided with repeatedly detachable connecting pieces at two sides of the opening, and two ends of the hoop cover are detachably connected through the connecting pieces.

Further, each of the connecting pieces comprises a fixed loop surface and a fixed hook surface respectively arranged at edge splicing places of upper and lower surfaces at two ends of the opening, and the fixed loop surface and the fixed hook surface being repeatedly bondable.

Further, the cover top surface is a single-layer fabric or at least two layers of fabric.

Further, the cover top surface is a single-layer fabric with top and bottom surfaces of same or different colors.

Further, a top fabric and a bottom fabric of the cover top surface are of same or different colors. When the top fabric and the bottom fabric are different colors, the trampoline can be turned over and replaced with a different color to solve the problem of monotonous and boring color schemes.

Further, the hoop cover further comprises a second side surface, the second side surface being cylindrical in shape, a circular edge at one side of the second side surface being connected to the outer rim edge of the cover top surface, the second side surface and the first side surface forming two layers of layered fabric, and a plurality of outer ring fixing straps being circumferentially distributed and fixedly connected to a joint between the second side surface and the first side surface. It is convenient for attaching the outer ring fixing straps to the trampoline frame when switching the hoop cover to a different side.

Further, the hoop cover comprises the first side surface of the cover top surface with a plurality of fan-ring shaped patchwork fabric pieces stitched together in a shape of a ring.

Further, the hoop cover is provided with an opening, the hoop cover is provided with repeatedly detachable connecting pieces at two sides of the opening, and two ends of the hoop cover are detachably connected through the connecting pieces.

Further, each of the connecting pieces comprises a fixed loop surface and a fixed hook surface respectively arranged at edge splicing places of upper and lower surfaces at two ends of the opening, and the fixed loop surface and the fixed hook surface being repeatedly bondable. Disconnecting the removable connection of the hoop cover allows the hoop cover to be turned over and fixed when installing the hoop cover on the trampoline without the need to remove the bottom of the hoop cover, saving handling time.

According to another aspect, a trampoline is provided, which includes: a main frame in an annular structure and a plurality of bottom support frames fixedly connected below the main frame; a bouncing cloth, an outer edge of the bouncing cloth being fixedly connected to the main frame through a plurality of springs; a hoop cover, the hoop cover comprising a cover top surface laid flat on an outer edge of a top surface of the trampoline and a first side surface wrapped around a side surface of an outer frame edge of the trampoline, surface being cylindrical in shape, and a circular edge at one side of the first side surface being fixedly connected to an outer rim edge of the cover top surface; a plurality of inner ring fixing straps are distributed along a circumferential direction at an inner rim edge of the cover top surface, each of the inner ring fixing straps capable of being bindingly attached to the trampoline when in use; and a plurality of outer ring fixing straps are distributed and fixedly connected along a circumferential direction at the outer rim edge of the cover top surface, and each of the outer ring fixing straps capable of being bindingly attached to the trampoline when in use.

Further, each of the plurality of bottom support frames is fixedly connected with one assembly rod, an upper end of the assembly rod is provided with a top connector, a fence is installed above the trampoline, an upper edge of the fence is fixedly connected to the top connector on the assembly rod, and a lower edge of the fence is fixedly connected to an outer rim edge of the bouncing cloth by a string.

Further, the side surface of the fence is also provided with a zipper, and the side surface of the fence across left and right sides of the zipper is provided with buckles, and two ends of the buckles are respectively fixedly connected to two sides of the zipper. The buckles are placed across the sides of the zipper to prevent the zipper from being ripped open when subjected to strong lateral forces. Disconnecting the removable connection of the hoop cover allows the hoop cover to be turned over and fixed when installing the hoop cover on the trampoline without the need to remove the bottom of the hoop cover, saving handling time.

Further, the assembly rod is further fixedly connected with a shooting device, left and right sides of the shooting device are respectively provided with reinforcing nets, the reinforcing nets are integrally triangular, one side edge of each of the reinforcing nets is fixedly connected to a side edge of the shooting device, and another side edge of each of the reinforcing nets is fixedly connected to an upper edge of the fence.

Further, the hoop cover is provided with one threading opening for allowing the outer ring fixing straps to penetrate the hoop cover at a position corresponding to each of the outer ring fixing straps so that when the hoop cover is fixed after turning over, each of the outer ring fixing straps is bindingly attached to the trampoline through the threading opening.

Further, the hoop cover is provided with an opening, the hoop cover is provided with repeatedly detachable connecting pieces at two sides of the opening, and two ends of the hoop cover are detachably connected through the connecting pieces. Each of the connecting pieces comprises a fixed loop surface and a fixed hook surface respectively arranged at edge splicing places of upper and lower surfaces at two ends of the opening, and the fixed loop surface and the fixed hook surface being repeatedly bondable.

Further, the hoop cover further comprises a second side surface, the second side surface being cylindrical in shape, a circular edge at one side of the second side surface being connected to the outer rim edge of the cover top surface, the second side surface and the first side surface forming two layers of layered fabric, and a plurality of outer ring fixing straps being circumferentially distributed and fixedly connected to a joint between the second side surface and the first side surface.

Further, the hoop cover is provided with an opening, two ends of the opening may be provided with repeatedly detachable connecting pieces, and two ends of the hoop cover are detachably connected through the connecting pieces; and each of the connecting pieces comprises a fixed loop surface and a fixed hook surface respectively arranged at edge splicing places of upper and lower surfaces at two ends of the opening, and the fixed loop surface and the fixed hook surface being repeatedly bondable.

According to the analysis of the hoop cover, the present disclosure discloses a hoop cover for a trampoline, which can be replaced on both sides, and the hoop cover is provided with a threading opening or a second side added as a second scheme, which is convenient for quickly binding the outer ring fixing strap when both sides are used. In addition, the hoop cover is provided with an opening which can disconnect the ring, and the opening is connected by a detachable connecting device, which is convenient for turning over the hoop cover when the fence is installed, and the operation is convenient.

BRIEF DESCRIPTION OF THE DRAWINGS

The accompanying drawings, forming part of the present application, serve to provide a further understanding for the present disclosure, and the exemplary embodiments of the present disclosure as well as the illustrations thereof serve to explain the present disclosure and do not constitute an undue limitation of the present disclosure. In the drawings.

DESCRIPTION OF REFERENCE NUMBERS

Figure 1:
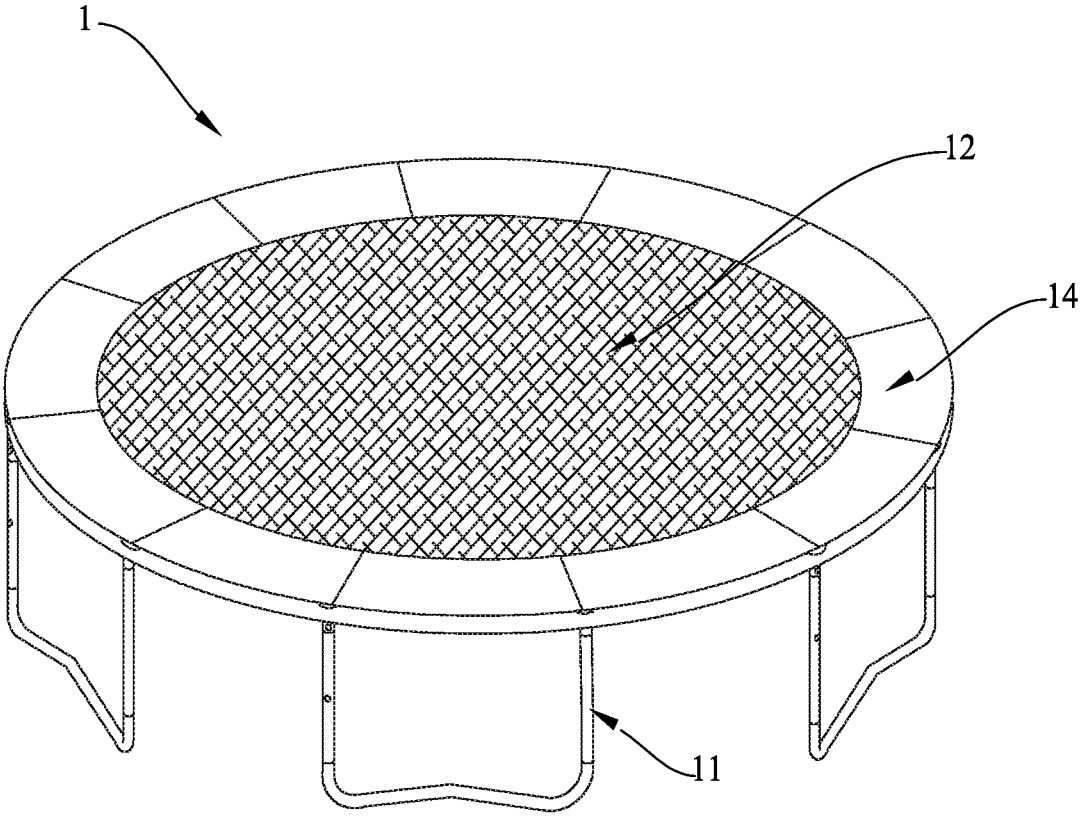
FIG. 1 is a structural schematic diagram of a trampoline in embodiment 1.

1—trampoline; 10—main frame; 11—bottom support frame; 12—bouncing cloth; 13—spring; 14—hoop cover; 140—opening; 141—cover top surface; 142—inner ring fixing strap; 143—first side surface; 144—outer ring fixing strap; 145—threading opening; 146—second side surface; 147—fixed loop surface; 148—fixed hook surface; 2—assembly rod; 21—top connector; 3—fence; 31—zipper; 32—buckle; 4—shooting device; 5—reinforcing net; 6—ladder.

DESCRIPTION OF THE EMBODIMENTS

The present disclosure will be described in detail below with reference to the accompanying drawings and in conjunction with embodiments. The various examples are provided by way of interpretation of the present disclosure and not limiting the present disclosure. Indeed, it will be apparent to those skilled in the art that modifications and variations may be made in the present disclosure without departing from the scope or spirit of the present disclosure. For example, features shown or described as part of one embodiment may be used in another embodiment to produce yet another embodiment. It is therefore desirable that the present disclosure encompass such modifications and variations falling within the scope of the appended claims and their equivalents.

In the description of the present disclosure, the terms "longitudinal", "transverse", "up", "down", "front", "back", "left", "right", "vertical", "horizontal", "top", "bottom" and the like denote orientation or positional relationships based on those shown in the drawings and are intended for ease of description only and not to require that the present disclosure must be constructed and operated in a particular orientation and therefore cannot be construed as limiting to the present disclosure. The terms "joint", "connect" and "set" used in the present disclosure should be understood in a broad sense, for example, which may refer to a fixed connection or a detachable connection; which may refer to a direct connection or an indirect connection through intermediate components; which may refer to a wired electrical connection, a radio connection, or a wireless communication signal connection, and the specific meanings of the above terms may be understood by those of ordinary skill in the art according to a specific situation.

One or more examples of the present disclosure are shown in the accompanying drawings. The detailed description uses numeric and alphabetic markers to refer to features in the drawings. Similar or like reference signs in the drawings and descriptions have been used to refer to similar or like parts of the present disclosure. As used herein, the terms "first", "second" and "third" and the like are used interchangeably to distinguish one member from another and are not intended to denote the location or importance of individual members.

Embodiment 1

As shown in FIGS. 1 to 6, according to embodiments of the present disclosure, there is provided a hoop cover for a trampoline, which includes a trampoline 1, the trampoline 1 includes an annular main frame 10, six bottom support frames 11 are connected below the main frame 10 to support the main frame 10 away from the ground. A bouncing cloth 12 is arranged in the annular interior of the main frame 10, and the outer rim edge of the bouncing cloth 12 is fixedly connected to the inner ring of the main frame 10 through a plurality of springs 13. Since there is a gap between the bouncing cloth 12 and the main frame 10, when a user jumps on the bouncing cloth 12, the user's feet are easily inserted into the spring gap between the bouncing cloth 12 and the main frame 10, which has a certain potential safety hazard. To eliminate this potential hazard, the trampoline 1 also comprises a hoop cover for the trampoline, the hoop cover 14 is annular, and the gap between the bouncing cloth 12 and the main frame 10 and the outer ring of the main frame 10 are covered on the inner side together.

The hoop cover 14 includes a cover top surface 141, the inner rim edge of the cover top surface 141 is provided with a plurality of inner ring fixing straps 142 in the circumferential direction for connecting with the outer edge of the bouncing cloth 12. The outer rim edge of the cover top surface 141 is connected with a first side surface 143, the first side surface 143 is in a cylindrical shape, and a circular edge of the first side surface 143 is fixedly connected to the outer rim edge of the cover top surface 141. When the hoop cover 14 covers the trampoline 1, the first side surface 143 covers the outer ring of the main frame 10 on the inner side. A plurality of outer ring fixing straps 144 are provided in the circumferential direction at the joint of the first side surface 143 and the cover top surface 141 for connecting with the bottom support frame 11. The first side surface 143 is respectively provided with a threading opening 145 corresponding to each of the outer ring fixing straps 144 for the outer ring fixing strap 144 to pass through. When the outer hoop cover 14 is flipped to the other side for use, the outer ring fixing straps 144 pass through the threading openings 145, which is convenient for a user to tie the outer ring fixing straps 144 to the bottom support frame 11.

The cover top surface 141 can be a structure having a single-layer fabric or at least two layers of fabric. When it is the single-layer fabric, the upper and lower surfaces of the cover top surface 141 can be designed to have the same color or different colors. When the upper and lower surfaces are of different colors, the color of the hoop cover 14 of the trampoline can be changed when the cover top surface 141 is turned over for use. Likewise, when the cover top surface 141 is of a multi-layer fabric structure, the upper and lower surfaces of the cover top surface 141 can be designed to have the same color or different colors. When the upper and lower surfaces of the cover top surface 141 are designed to have different colors, the use color of the hoop cover 14 of the trampoline can be changed when the cover top surface 141 is turned over for use. In addition, the cover top surface 141 of the hoop cover 14 may be formed by a plurality of fan-ring shaped patchwork fabric pieces stitched together, to form a different color patchwork, which enriches the color of the hoop cover 14 and can meet the preferences of different consumers.

The six bottom support frames 11 of the trampoline 1 are respectively fixedly connected with one assembly rod 2, the assembly rod 2 is perpendicular to an upper surface of the trampoline 1, and an upper end of the assembly rod 2 is provided with a top connector 21. A fence 3 is fitted above the trampoline 1. An upper edge of the fence 3 is fixedly connected to the top connector 21 on the assembly rod 2, and a lower edge of the fence 3 is fixedly connected to an outer rim edge of the bouncing cloth 12 by a string. The user can move around in the fence 3 to prevent falling. The side surface of the fence 3 is also provided with a zipper 31, which is convenient for users to enter and exit the fence 3 after opening the zipper 31. Two buckles 32 are arranged on the side of the fence 3 across the left and right sides of the zipper 31, and two ends of each buckle 32 are fixedly connected to both sides of the zipper 31, respectively. When the buckles 32 are snapped together, the strength of the zipper 31 can be increased, and the zipper 31 can be prevented from being torn apart after being subjected to strong transverse force.

Figure 5:
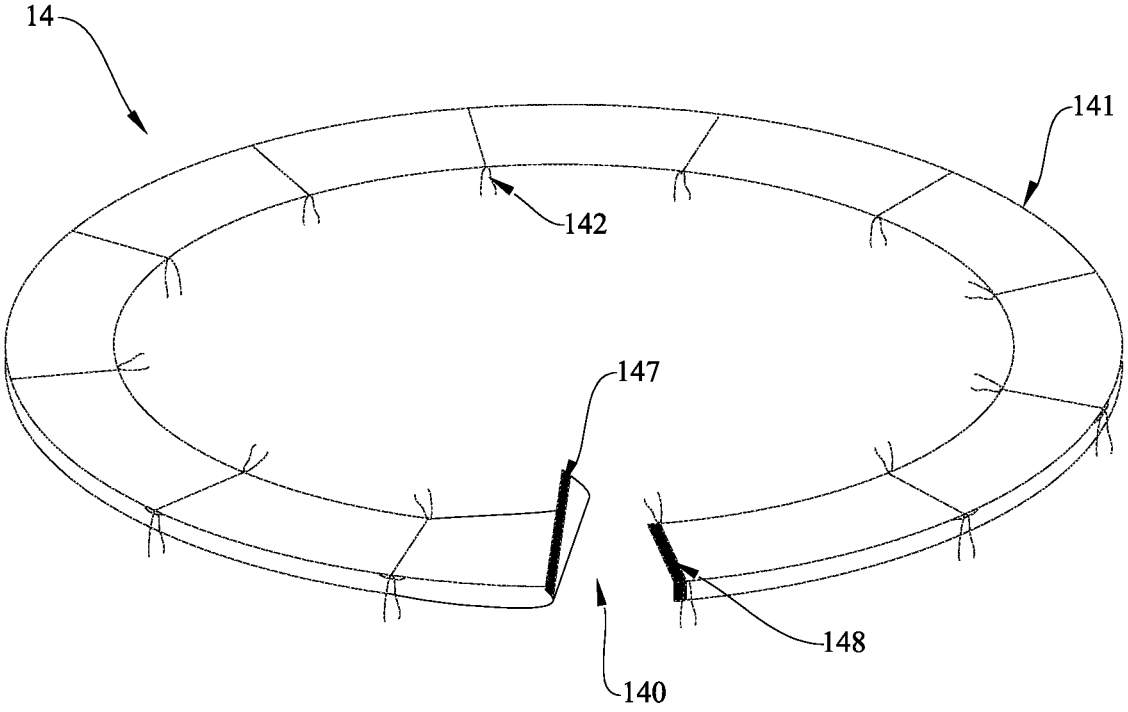
FIG. 5 is a structural schematic diagram of the hoop cover provided with an opening in embodiment 1.

After the fence 3 is installed on the trampoline 1, it is inconvenient to change the surface of the hoop cover 14. It is necessary to disassemble the bottom of the fence 3, then turn over the fence 14 and cover it on the trampoline 1, and then fix the lower edge of the fence 3 again, which is time-consuming and laborious. In order to solve the above problems, as shown in FIG. 5, the hoop cover 14 is provided with an opening 140 to disconnect the annular hoop cover 14, and a detachable connecting piece is provided at the opening 140 for fixing. In this embodiment, a fixed loop surface 147 is arranged on the hoop cover 14 at one side of the opening 140, and a fixed hook surface 148 is arranged on the hoop cover 14 at the other side of the opening 140. The fixed loop surface 147 is matched with the fixed hook surface 148 to form a connecting piece that can be detached repeatedly. When it is necessary to change the hoop cover 14 by turning over, the fixed loop surface 147 and the fixing hook surface 148 are torn apart, to release the attachment of the inner ring fixing strap 142 and the outer ring fixing strap 144 to the trampoline 1, then the hoop cover 14 is turned over, the hoop cover 14 is surrounded the fence 3 through the opening 140 and then is re-secured into an annular shape by the connecting pieces, and the inner ring fixing strap 142 and the outer ring fixing strap 144 are fixedly connected to the trampoline 1. There is no need to disassemble the fence 3, so that the face changing process is shortened and time is saved. The opening 140 may be provided with other detachable connection devices, such as a connection by hook and loop, zipper connection, strap connection, etc., and the detachable connection at the opening 140 may be achieved in a ring shape. In this embodiment, the detachable connection devices at the disconnection will not be described in detail.

One assembly rod 2 is also fixedly connected to a shooting device 4, and the left and right sides of the shooting device 4 are respectively provided with reinforcing nets 5, the reinforcing nets 5 are triangular, one side edge of the reinforcing nets 5 is fixedly connected to the side edge of the shooting device 4, the other side edge of the reinforcing nets 5 is fixedly connected to the upper edge of the fence 3, and the reinforcing nets 5 are respectively arranged on both sides of the shooting device 4 to prevent the shooting device 4 from rotating after being hit by the ball, and to form fence on both sides of the shooting device 4 to prevent the ball from throwing out the outer side of the fence 3.

The main frame 10 is also provided with a ladder 6, which is convenient for users to walk on the trampoline 1 with the aid of the ladder 6.

Embodiment 2

Figure 2:
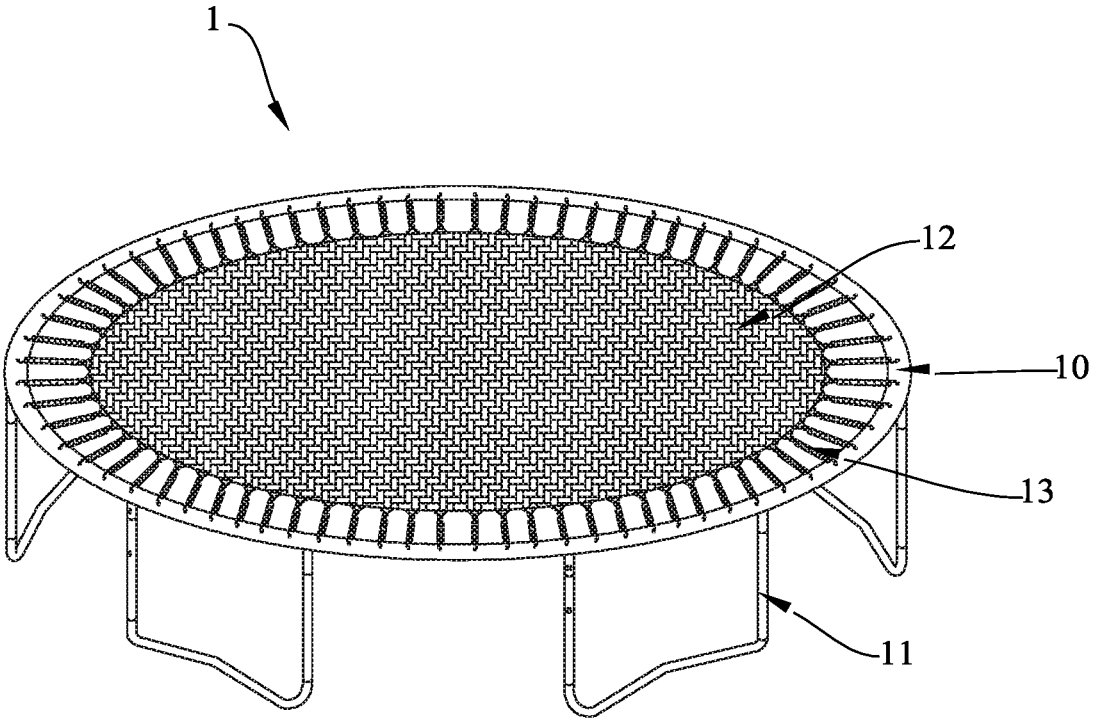
FIG. 2 is a structural schematic diagram of the trampoline without a hoop cover in embodiment 1.
Figure 3:
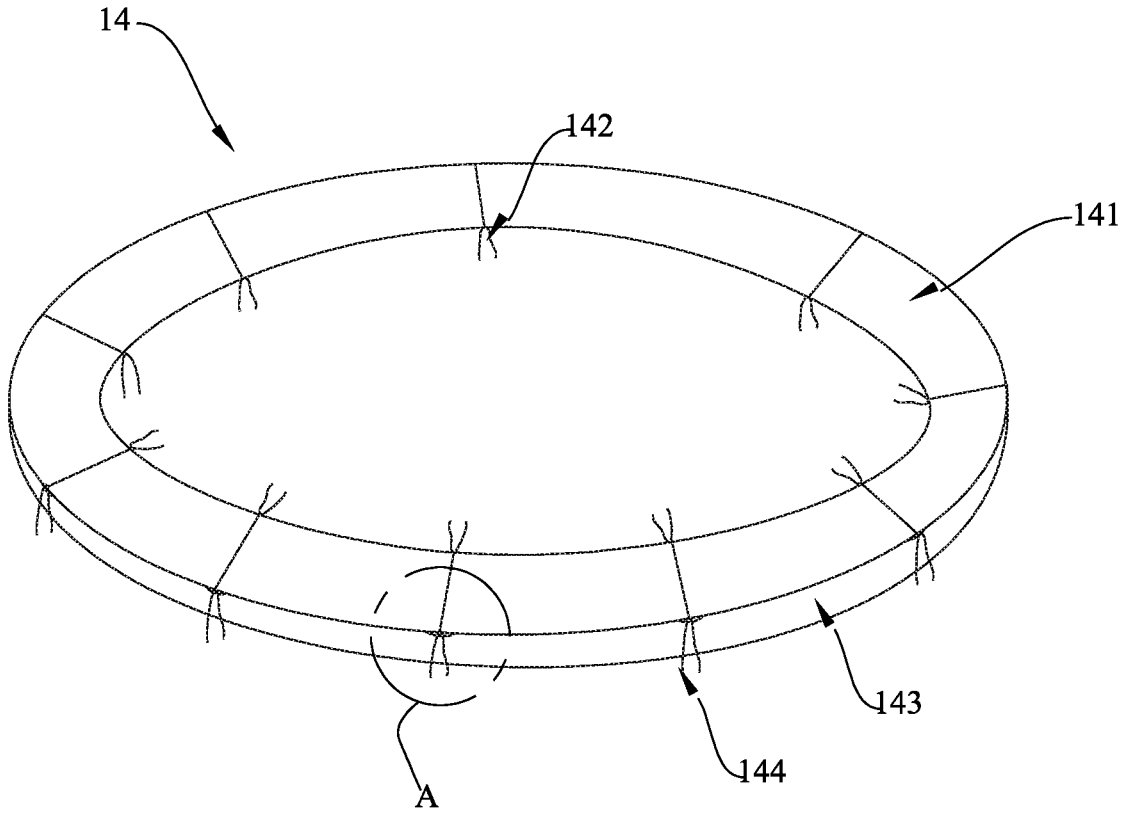
FIG. 3 is a structural schematic diagram of the hoop cover in embodiment 1.
Figure 4:
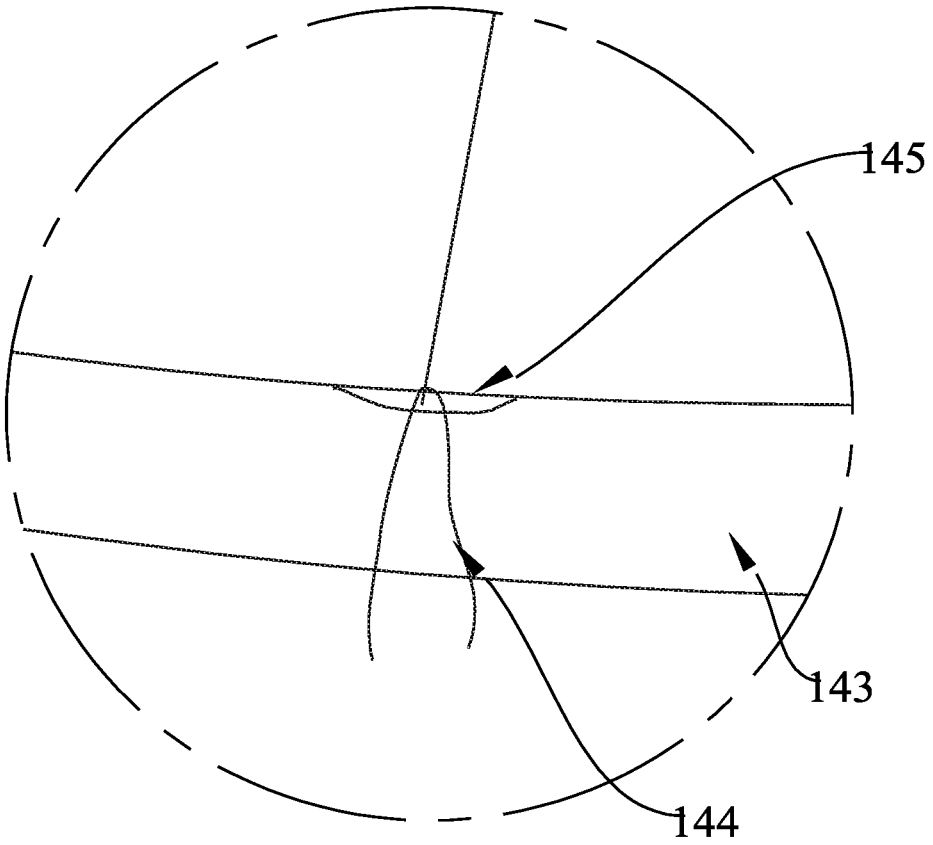
FIG. 4 is a partially enlarged structural diagram at part A in FIG. 3.
Figure 6:
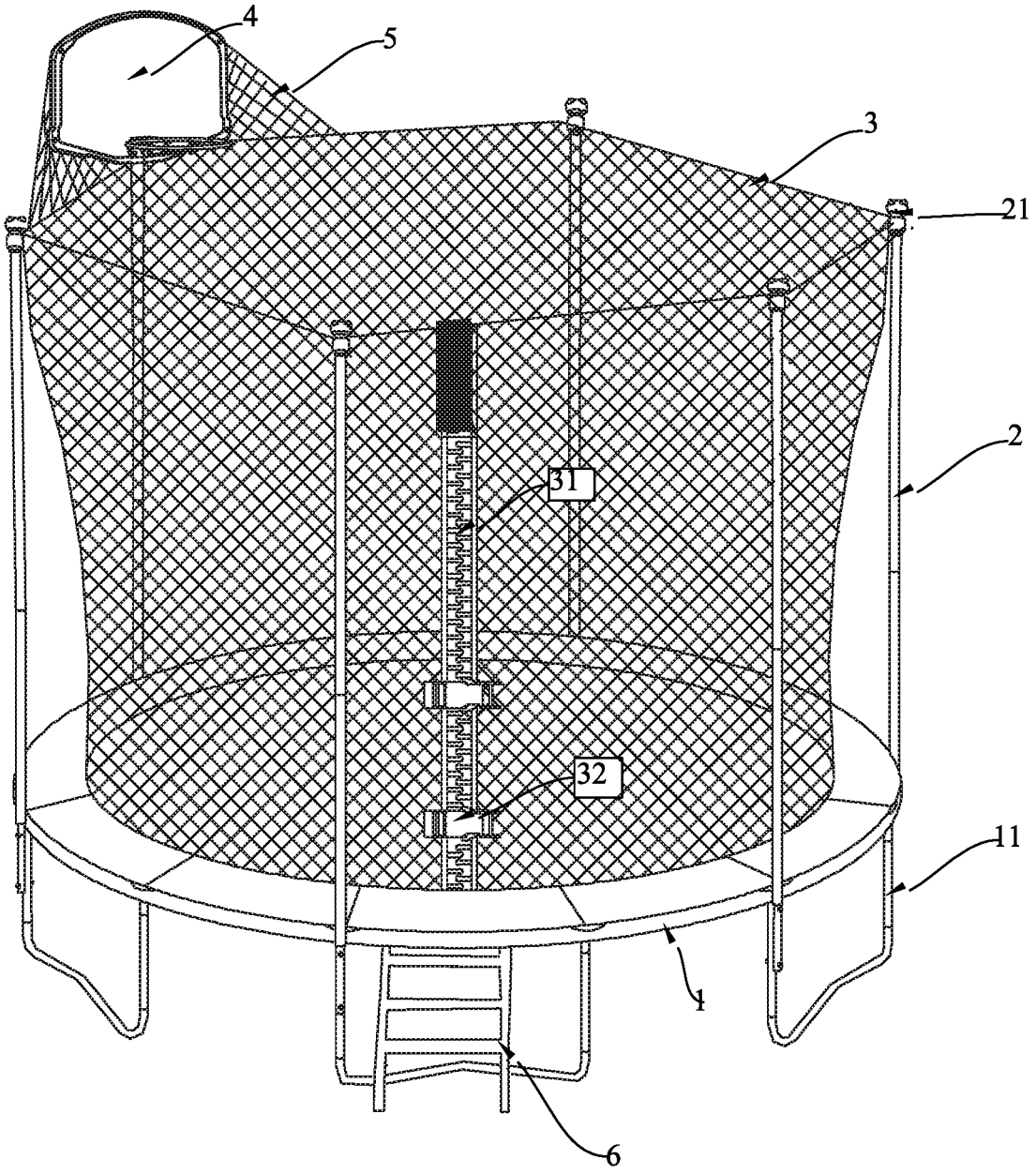
FIG. 6 is a structural schematic diagram of the trampoline provided with a fence and a shooting device in embodiment 1.
Figure 7:
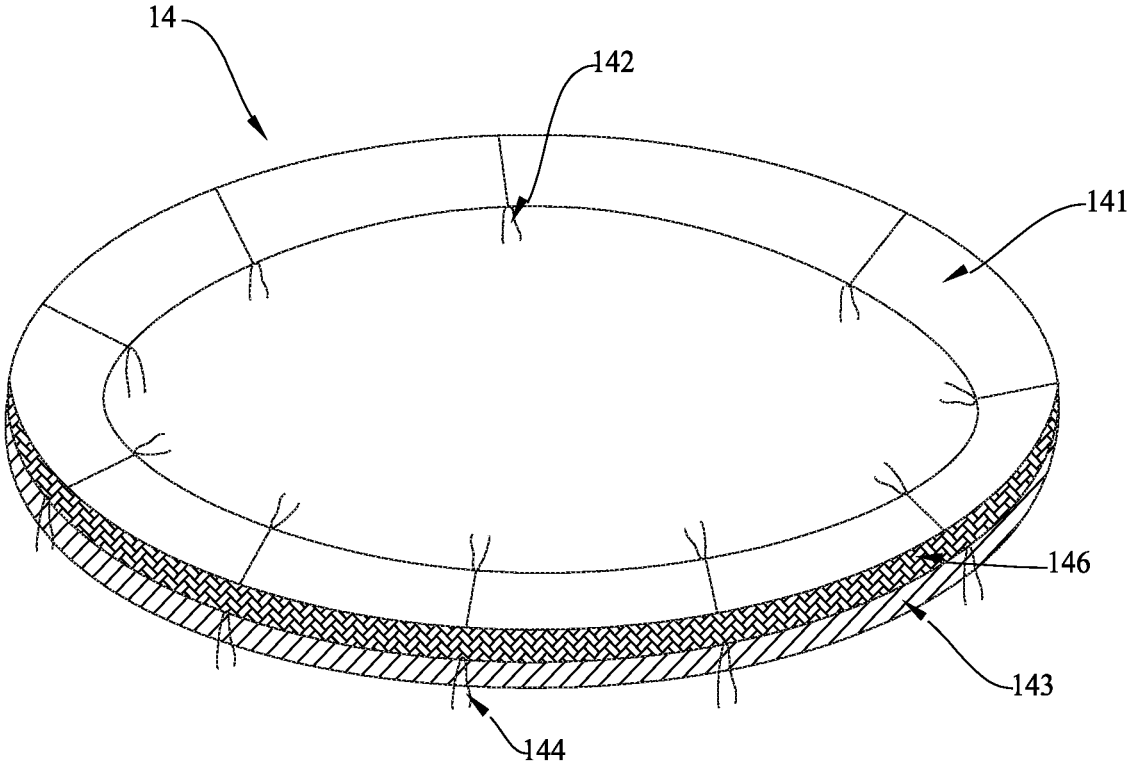
FIG. 7 is a structural schematic diagram of the hoop cover in embodiment 2.

As shown in FIG. 2, FIG. 5 and FIG. 6, the structure of the trampoline 1 in this embodiment and the structure of the mounting lever 2, the fence 3, the shooting device 4, the reinforcing net 5 and the ladder 6 mounted on the trampoline are the same as the corresponding structure described in the embodiment 1, and the mounting mode is the same as the mounting mode of the corresponding components described in the embodiment 1. However, each of the outer ring fixing straps 144 needs to penetrate the threading opening 145 when the hoop cover 14 in the embodiment 1 is turned over and fixed, which is complicated and time consuming. In view of the above problems, the hoop cover 14 in this embodiment is further improved. As shown in FIG. 7, the hoop cover 14 in this embodiment includes a cover top surface 141 laid flat on an outer edge of a top surface of the trampoline and a first side surface 143 wrapped around a side surface of an outer frame edge of the trampoline, the first side surface 143 is cylindrical in shape, and a circular edge at one side of the first side surface 143 is fixedly connected to the cover top surface 141. The hoop cover further comprises a second side surface 146, the second side surface 146 is cylindrical in shape, a circular edge at one side of the second side surface 146 is connected to the outer rim edge of the cover top surface 141, the second side surface 146 and the first side surface 143 form two layers of layered fabric, and a plurality of outer ring fixing straps 144 are circumferentially distributed and fixedly connected to a joint between the second side surface 146 and the first side surface 143, to sandwich the outer ring fixing straps 144 between the first side surface 143 and the second side surface 146. As shown in FIG. 7, part of the second side surface 146 is folded upwards to expose the first side surface 143 and the outer ring fixing strap 144. When in use, the second side surface 146 faces upward, the first side surface 143 is folded inward so that the first side surface 143 is interposed between the lower surface of the cover top surface 141 and the upper surface of the trampoline 1, and the second side surface 146 is wrapped around the outer edge of the trampoline 1. Then the outer ring fixing strap 144 is fixedly attached to the bottom support frame 11, and then the inner ring fixing strap 142 is fixedly connected to the outer edge of the bouncing cloth 12 to complete fixing. When the hoop cover 14 is turned over to the other side, the first side surface 143 faces upward. When the hoop cover 14 is fixed, the second side surface 146 is first folded inward so that it is interposed between the lower surface of the cover top surface 141 and the upper surface of the trampoline 1, and the first side surface 143 is wrapped around the outer edge of the trampoline 1. Then, the outer ring fixing strap 144 is fixedly attached to the bottom support frame 11 to complete the turning of the trampoline cover 14.

Likewise, as shown in FIG. 5, the hoop cover 14 in the present embodiment is also for the convenience of changing the face when installing the hoop cover 3. The hoop cover 14 is provided with an opening 140 to disconnect the annular hoop cover 14, and a detachable connecting piece is provided at the opening 140 for fixing. Each of the connecting pieces comprises a fixed loop surface 147 and a fixed hook surface 148 respectively arranged at edge splicing places of upper and lower surfaces at two ends of the opening 140 to achieve repeated bonding at the opening 140. In addition, the connecting piece at the opening 140 can be provided with other detachable connecting pieces, such as a connection by hook and loop, zipper connection, strap connection, etc., and the detachable connection at the opening 140 may be achieved in a ring shape. In this embodiment, the detachable connection devices at the disconnection will not be described in detail.

Likewise, in the present embodiment, the cover top surface 141 be a structure having a single-layer fabric or at least two layers of fabric, or it may be a multi-layer fabric with at least three-layer of fabric. When it is the single-layer fabric, the upper and lower surfaces of the cover top surface 141 can be designed to have the same color or different colors. When the upper and lower surfaces are of different colors, the color of the hoop cover 14 of the trampoline can be changed when the cover top surface 141 is turned over for use. Likewise, when the cover top surface 141 is of a multi-layer fabric structure, the upper and lower surfaces of the cover top surface 141 can be designed to have the same color or different colors. When the upper and lower surfaces of the cover top surface 141 are designed to have different colors, the use color of the hoop cover 14 of the trampoline can be changed when the cover top surface 141 is turned over for use. In addition, the cover top surface 141 of the hoop cover 14 has a single-layer fabric or a multi-layer fabric structure, and both side surfaces of the cover top surface 141 can be formed by splicing a plurality of fan-ring splicing fabrics, to form a different color patchwork, which enriches the color of the hoop cover 14 and can meet the preferences of different consumers.

From the above description, it can be seen that the above embodiment of the present disclosure achieves the following technical effects:

1. the hoop cover 14 is arranged on the trampoline 1, and the upper and lower surfaces of the hoop cover 14 can be designed to different colors, and different colors can be replaced when the hoop cover is turned over and stably bounded, thereby solving problems of dull and boring colors of the hoop cover.
2. The hoop cover 14 is provided with the threading opening 145 at the position of the outer ring fixing strap 144, so that the outer ring fixing strap 144 is conveniently attached to the bottom support frame 11 through the threading opening 145 after turning over.

3. A first side surface 143 and a second side surface 146 are arranged at the outer rim edge of the cover top surface 141 of the hoop cover 14, and an outer ring fixing strap 144 is arranged between the first side surface 143 and the second side surface 146, so as to facilitate the connection between the outer ring fixing strap 144 and the bottom support frame 11 when the hoop cover 14 is switched to different surfaces.
4. A fence 3 is installed on the trampoline 1, and a zipper 31 is arranged on the side of the fence 3 to facilitate users to enter and exit the fence 3, and the buckles 32 are arranged at the zipper 31, the buckles 32 are placed across both sides of the zipper 31 to prevent the zipper 31 from being torn apart after being subjected to strong transverse force.
5. The hoop cover 14 is provided with an opening 140, and both ends of the opening 140 are connected by detachable connecting pieces. After the detachable connecting piece of the hoop cover 14 is disconnected, the hoop cover 14 is conveniently turned over and fixed when the hoop cover 3 is installed on the trampoline 1, and the bottom of the hoop cover 3 does not need to be disassembled, which saves operation time.

Compared with the prior art, the trampoline hoop cover of the present disclosure can be replaced on both sides, so as to meet the requirements of color saving cost and convenient connection for changing surfaces. The hoop cover is provided with a threading opening or a second side surface, which is convenient for fixing the outer ring fixing strap when both surfaces are used, that is, the hoop cover can also be fixed with the same outer ring fixing strap when it is turned over. In addition, the hoop cover is provided with an opening which can disconnect the ring, and the opening is connected by a detachable connecting device, which is convenient for turning over the hoop cover when the fence is installed, and the operation is convenient.

The foregoing is merely a preferred embodiment of the present disclosure and is not intended to limit the present disclosure which may be subject to various modifications and variations to those skilled in the art. Any modification, equivalent replacement, improvement, etc. made within the spirit and principles of the present disclosure should be included in the scope of protection of the present disclosure.

What is claimed is:

1. A hoop cover for a trampoline, wherein the hoop cover comprises:

a cover top surface laid flat on an outer edge of a top surface of the trampoline and a first side surface wrapped around a side surface of an outer frame edge of the trampoline, the first side surface being cylindrical in shape;

a plurality of inner ring fixing straps being distributed along a circumferential direction at an inner rim edge of the cover top surface, each inner ring fixing strap of the inner ring fixing straps being bindingly attached to an outer edge of a bouncing cloth of the trampoline when in use;

the cover top surface comprising at least two layers of fabric, the at least two layers of fabric comprising a top fabric and a bottom fabric of different colors; and the hoop cover further comprising a second side surface, the second side surface being cylindrical in shape, a circular edge at one side of the second side surface being connected to an outer rim edge of the cover top surface, another circular edge at another side of the second side surface being connected to an upper rim edge of the first side surface; the second side surface and the first side surface forming two layers of layered fabric, a plurality of outer ring fixing straps being circumferentially distributed and fixedly connected to a joint between the second side surface and the first side surface, and each outer ring fixing strap of the plurality of outer ring fixing straps being bindingly attached to a corresponding bottom support frame of a plurality of bottom support frames of the trampoline when in use.

2. The hoop cover for the trampoline according to claim 1, wherein the hoop cover is provided with a plurality of threading openings, each threading opening of the plurality of threading openings is provided at a position corresponding to each outer ring fixing strap of the outer ring fixing straps so that when the hoop cover is fixed after turning over, each outer ring fixing strap of the outer ring fixing straps is bindingly attached to the trampoline through a corresponding threading opening of the plurality of threading openings.

3. The hoop cover for the trampoline according to claim 2, wherein the hoop cover is provided with an opening, the hoop cover is provided with repeatedly detachable connecting pieces at two sides of the opening, and two ends of the hoop cover are detachably connected through the repeatedly detachable connecting pieces.

4. The hoop cover for the trampoline according to claim 3, wherein each of the repeatedly detachable connecting pieces comprises a fixed loop surface and a fixed hook surface respectively arranged at edge splicing places of upper and lower surfaces at two ends of the opening, and the fixed loop surface and the fixed hook surface being repeatedly bondable.

5. The hoop cover for the trampoline according to claim 2, wherein the hoop cover comprises the cover top surface with a plurality of fan-ring shaped patchwork fabric pieces stitched together in a shape of a ring.

6. The hoop cover for the trampoline according to claim 1, wherein the hoop cover is provided with an opening, the hoop cover is provided with repeatedly detachable connecting pieces at two sides of the opening, and two ends of the hoop cover are detachably connected through the repeatedly detachable connecting pieces.

7. The hoop cover for the trampoline according to claim 6, wherein each of the repeatedly detachable connecting pieces comprises a fixed loop surface and a fixed hook surface respectively arranged at edge splicing places of upper and lower surfaces at two ends of the opening, and the fixed loop surface and the fixed hook surface being repeatedly bondable.

8. The hoop cover for the trampoline according to claim 1, wherein the hoop cover comprises the first side surface of the cover top surface with a plurality of fan-shaped patchwork fabric pieces stitched together in a shape of a ring.

9. A trampoline, comprising:

a main frame in an annular structure and a plurality of bottom support frames fixedly connected below the main frame;

a bouncing cloth, an outer edge of the bouncing cloth being fixedly connected to the main frame through a plurality of springs;

a hoop cover, the hoop cover comprising a cover top surface laid flat on an outer edge of a top surface of the trampoline and a first side surface wrapped around a side surface of an outer frame edge of the trampoline, the first side surface being cylindrical in shape; a plurality of inner ring fixing straps being distributed along a circumferential direction at an inner rim edge of the cover top surface, each inner ring fixing strap of the plurality of inner ring fixing straps being bindingly attached to the outer edge of the bouncing cloth of the trampoline;

the cover top surface comprising at least two layers of fabric, the at least two layers of fabric comprising a top fabric and a bottom fabric of different colors; and the hoop cover further comprising a second side surface, the second side surface being cylindrical in shape, a circular edge at one side of the second side surface being connected to an outer rim edge of the cover top surface, another circular edge at another side of the second side surface being connected to an upper rim edge of the first side surface; the second side surface and the first side surface forming two layers of layered fabric, a plurality of outer ring fixing straps being circumferentially distributed and fixedly connected to a joint between the second side surface and the first side surface, and each outer ring fixing strap of the plurality of outer ring fixing straps being bindingly attached to a corresponding bottom support frame of the plurality of bottom support frames.

10. The trampoline according to claim 9, wherein each bottom support frame of the plurality of bottom support frames is fixedly connected with one assembly rod, an upper end of the assembly rod is provided with a top connector, a fence is installed above the trampoline, an upper edge of the fence is fixedly connected to the top connector on the assembly rod, and a lower edge of the fence is connected to an outer rim edge of the bouncing cloth.

11. The trampoline according to claim 10, wherein a side surface of the fence is further provided with a zipper, and the side surface of the fence across left and right sides of the zipper is provided with buckles, and two ends of the buckles are respectively fixedly connected to two sides of the zipper.

12. The trampoline according to claim 10, wherein the assembly rod is further fixedly connected with a shooting device, left and right sides of the shooting device are respectively provided with reinforcing nets, the reinforcing nets are integrally triangular, one side edge of each of the reinforcing nets is fixedly connected to a side edge of the shooting device, and another side edge of each of the reinforcing nets is fixedly connected to an upper edge of the fence.

13. The trampoline according to claim 9, wherein the hoop cover is provided with a plurality of threading openings, each threading opening of the plurality of threading openings is provided at a position corresponding to each outer ring fixing strap of the plurality of outer ring fixing straps so that when the hoop cover is fixed after turning over, each outer ring fixing strap of the plurality of outer ring fixing straps is bindingly attached to the trampoline through a corresponding threading opening of the plurality of threading openings.

14. The trampoline according to claim 13, wherein the hoop cover is provided with an opening, the hoop cover is provided with repeatedly detachable connecting pieces at two sides of the opening, and two ends of the hoop cover are detachably connected through the repeatedly detachable connecting pieces; and each of the repeatedly detachable connecting pieces comprises a fixed loop surface and a fixed hook surface respectively arranged at edge splicing places of upper and lower surfaces at two ends of the opening, and the fixed loop surface and the fixed hook surface being repeatedly bondable.

15. The trampoline according to claim 9, wherein the hoop cover is provided with an opening, the hoop cover is provided with repeatedly detachable connecting pieces at two sides of the opening, and two ends of the hoop cover are detachably connected through the repeatedly detachable connecting pieces; and each of the repeatedly detachable connecting pieces comprises a fixed loop surface and a fixed hook surface respectively arranged at edge splicing places of upper and lower surfaces at two ends of the opening, and the fixed loop surface and the fixed hook surface being repeatedly bondable.

* * * * *